US006070527A

United States Patent [19]

Yamane et al.

[11] Patent Number: 6,070,527

[45] Date of Patent: Jun. 6, 2000

[54] PLATE MATERIAL FOR LASER PLATE MAKING

[75] Inventors: Minoru Yamane, Tochigi; Osamu Majima, Tokyo, both of Japan

[73] Assignees: Sony Corporation; Sony Chemicals Corporation, both of Tokyo, Japan

[21] Appl. No.: 08/811,257

[22] Filed: Mar. 4, 1997

Related U.S. Application Data

[63] Continuation of application No. 08/416,223, Apr. 4, 1995, abandoned.

[30] Foreign Application Priority Data

Apr. 4, 1994 [JP] Japan ..... 6-090526

[51] Int. Cl.[7] ..... B41N 1/12

[52] U.S. Cl. ..... 101/150; 101/153; 101/163; 101/395; 101/401

[58] Field of Search ..... 101/150, 153, 101/163, 170, 395, 401, 401.1, 467

[56] References Cited

U.S. PATENT DOCUMENTS

| | | | |
|---|---|---|---|
| 3,964,389 | 6/1976 | Peterson | 101/401.1 |
| 4,528,909 | 7/1985 | Rigg et al. | 101/170 |
| 4,566,384 | 1/1986 | Matsumoto | 101/170 |
| 5,378,580 | 1/1995 | Leenders | 101/467 |
| 5,396,841 | 3/1995 | Güls | 101/401.1 |

FOREIGN PATENT DOCUMENTS

| | | | |
|---|---|---|---|
| 312889 | 11/1992 | Japan . | |
| 42781 | 2/1993 | Japan . | |
| 2087796 | 6/1982 | United Kingdom | 101/170 |

*Primary Examiner*—Stephen R. Funk
*Attorney, Agent, or Firm*—Hill & Simpson

[57] ABSTRACT

A plate material for laser plate making contains a thermoplastic resin, a light absorbing agent and a water repellent or an oil repellent.

7 Claims, 3 Drawing Sheets

FIG. 3

| compounding amount (parts by weight) | | | | | | | | | | | | | | | | |
|---|---|---|---|---|---|---|---|---|---|---|---|---|---|---|---|---|
| component \ inventive example | 1 | 2 | 3 | 4 | 5 | 6 | 7 | 8 | 9 | 10 | 11 | 12 | 13 | 14 | 15 | 16 |
| light absorbing agent (carbon black) | 15 | 15 | 15 | 15 | 15 | 15 | 14 | 14 | 15 | 15 | 15 | 15 | 15 | 15 | 14 | 14 |
| thermoplastic resin (polyester) | 46 | 46 | 46 | 45 | 45 | 45 | 44 | 44 | 46 | 46 | 46 | 45 | 45 | 45 | 44 | 44 |
| nitrocellulose | 32 | 32 | 31 | 31 | 31 | 31 | 31 | 30 | 32 | 32 | 31 | 31 | 31 | 31 | 31 | 30 |
| dispersing agent (DA-400) | 2 | 2 | 2 | 2 | 2 | 2 | 2 | 2 | 2 | 2 | 2 | 2 | 2 | 2 | 2 | 2 |
| curing agent (melamine) | 4 | 4 | 4 | 4 | 4 | 4 | 4 | 4 | 4 | 4 | 4 | 4 | 4 | 4 | 4 | 4 |
| leveling agent (KP340) | 2 | 2 | 2 | 2 | 2 | 2 | 2 | 2 | 2 | 2 | 2 | 2 | 2 | 2 | 2 | 2 |
| fluorine water-repellent (EF-601) | 0.4 | 0.6 | 0.8 | 1.2 | 2.0 | 2.8 | 3.3 | 4.1 | – | – | – | – | – | – | – | – |
| fluorine water-repellent (EF-801) | – | – | – | – | – | – | – | – | 0.4 | 0.6 | 0.8 | 1.2 | 2.0 | 2.8 | 3.3 | 4.0 |

FIG. 4

| | inventive example | | | | | | | | | | | | | | | |
|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 |
| contact angle (°) before radiation of laser light | 55 | 58 | 60 | 62 | 65 | 68 | 75 | 80 | 60 | 65 | 72 | 74 | 76 | 78 | 85 | 89 |
| contact angle (°) after radiation of laser light | 47 | 48 | 48 | 49 | 50 | 51 | 51 | 52 | 50 | 50 | 51 | 51 | 52 | 52 | 52 | 53 |
| | comparative example | | | | | | | | | | | | | | | |
| | 1 | 2 | 3 | 4 | 5 | 6 | 7 | 8 | 9 | 10 | 11 | 12 | 13 | 14 | 15 | 16 |
| contact angle (°) before radiation of laser light | 34 | 33 | 32 | 33 | 35 | 37 | 34 | 35 | 34 | 33 | 36 | 32 | 33 | 34 | 35 | 32 |
| contact angle (°) after radiation of laser light | 31 | 31 | 30 | 29 | 32 | 32 | 31 | 32 | 30 | 29 | 32 | 30 | 30 | 31 | 30 | 30 |

PLATE MATERIAL FOR LASER PLATE MAKING

CROSS-REFERENCE TO RELATED APPLICATION

This application is a continuation of application Ser. No. 08/416,223, filed Apr. 4, 1995, now abandoned.

BACKGROUND OF THE INVENTION

The present invention relates to a plate material used to manufacture an intaglio by a laser plate-making system.

Recently, as it becomes popular to carry out a desktop publishing with some proper equipments, such as a word processor, a personal computer or the like, various kinds of printing methods with high speed and high resolution are proposed. However, these proposed printing methods are encountered by the problem that they are not suitable for the mass printing and that it is impossible to print a full-color image with an excellent gradation.

On the other hand, a printing method suitable for mass printing of a full-color image with excellent gradation includes a gravure printing, for example. An intaglio used in the gravure printing is generally a metal intaglio manufactured by plate making methods, such as a conventional gravure method, an inverted halftone gravure method, a mechanical engraving method or the like. The intaglio usually has a hard chromium-plated layer provided on its surface and hence becomes resistant to scratch and abrasion and high in durability. However, when the intaglio is manufactured, manufacturing processes thereof are complicated and manufacturing equipments therefor are large-sized. Therefore, the gravure printing is encountered by the problem that a printing plate cannot be manufactured with ease within a short period of time and that it costs much to print only a small amount of copies.

In view of such problems, there has been proposed a printing method in which a printing plate that allows the full-color image with excellent gradation to be printed can be manufactured with ease and which is suitable when a small or large amount of copies are to be printed, i.e., a method (U.S. Pat. No. 5,126,531; DIGIC, 30 (published by SONY CORP in January, 1994)) in which an intaglio made of thermoplastic resin is manufactured by a laser plate-making system and used for the gravure printing. According to the laser plate-making system, a laser beam is radiated on a plate sheet made of the thermoplastic resin and a radiated portion thereof is melted, decomposed, burned or sublimated to form concavities with a depth of about 8 $\mu$m on a surface of the plate sheet. In this laser plate-making system, when the laser beam is radiated, if a pulse width of the laser beam or an intensity thereof is modulated in response to a gradation of an image to be formed, then an intaglio made of resin which can be used for the printing with gradation is manufactured. Accordingly, according to the laser plate-making system, it becomes possible to manufacture the intaglio with lower costs in more simplified processes within a shorter time as compared with general gravure plate making methods, such as the conventional gravure method, the inverted halftone gravure method, the mechanical engraving method or the like.

For such laser plate making, a plate material has been proposed (in Japanese Published Patent Publication No. 246165/1993) which is compounded of some materials, such as a thermoplastic resin, a carbon black as a light absorbing agent for absorbing laser light and changing it to thermal energy, a curing agent for improving solvent resistance and abrasion resistance of the plate sheet, or the like.

When the gravure printing is carried out with the intaglio made of such plate material by the laser plate-making system, as shown in FIG. 1, an intaglio 12 is wound around a printing cylinder 11 and a water-base or oil-base ink 14 stored in an ink fountain 13 is supplied to a surface of the intaglio 12 by an ink roller 15. Any unnecessary ink is removed from the surface of the intaglio 12 by a doctor blade 16 to leave the ink 14 only in concavities 17 formed on the surface of the intaglio 12. Then, the ink 14 left in the concavities 17 is transferred to a printing paper 19 conveyed by a feeding roller 18. Thus, it is possible to print the full-color image with excellent gradation in houses and offices.

However, the resin intaglio made of a plate material for laser plate making disclosed in Japanese Laid-open Patent Publication No. 246165/1993 has disadvantage that its surface hardness is remarkably low as compared with the hard chromium-plated metal plate. Therefore, when comparatively large pigment particles contained in the ink or a talc and a clay detached from the printing paper are pressed by the doctor blade against the surface of the intaglio, linear scratches with depth (about 2 to 3 $\mu$m) of an order approximate to a plate depth (about 8 $\mu$m) are made as the plate material is used repeatedly. The ink enters the scratches and causes scumming and linear scumming on a printed matter to thereby lower printing quality. To improve this disadvantage, it is demanded to increase the number of copies which can be printed with one printing plate without the printing quality being lowered.

SUMMARY OF THE INVENTION

In view of the above-mentioned aspects, an object of the present invention is that, when the printing is carried out with an intaglio formed of a plate material for laser plate making made of thermoplastic resin and a light absorbing agent, printing quality is prevented from being lowered and a dimensional stability of such intaglio is improved.

The same assignees of the present application have discovered that when the plate material for laser plate making contains a water repellent if an ink to be used is a water base ink and contains an oil repellent if the ink to be used is an oil base ink, the plate material can achieve the above-mentioned objects.

Specifically, an object of the present invention is to provide a plate material for laser plate making which contains the thermoplastic resin and the light absorbing agent and further contains the water repellent or the oil repellent.

According to a first aspect of the present invention, a plate material for laser plate making containing a thermoplastic resin and a light absorbing agent contains a water repellent or an oil repellent.

According to a second aspect of the present invention, the plate material for laser plate making contains a water repellent or an oil repellent of 0.5 to 20 weight %.

According to a third aspect of the present invention, a water repellent or an oil repellent is a fluorine water-repellent or oil-repellent, a silane water-repellent or oil-repellent, a siliconate water-repellent or oil-repellent, a silicone water-repellent or oil-repellent, or an acrylic resin water-repellent or oil-repellent.

According to a fourth aspect of the present invention, the plate material for laser plate making further contains nitrocellulose.

According to a fifth aspect of the present invention, a plate material for laser plate making contains a thermoplastic resin of 10 to 90 weight %, nitrocellulose of 10 to 90 weight % and a light absorbing agent of 5 to 25 weight %.

According to a sixth aspect of the present invention, the thermoplastic resin is polyester and the light absorbing agent is carbon black.

According to a seventh aspect of the present invention, a contact angle of an ink before radiation of laser light is larger as compared with that after radiation of laser light.

According to an eighth aspect of the present invention, a plate sheet material for printing contains a base sheet and a laser engraving layer made of the above plate material for laser plate making. The laser engraving layer is formed on the base sheet.

BRIEF DESCRIPTION OF THE DRAWINGS

FIG. 3 is a table showing compounding amounts of components used in inventive examples 1 through 16; and FIG. 4 is a table showing measured results of contact angles with respect to inventive examples 1 through 16 and comparative examples 1 through 16.

DESCRIPTION OF THE PREFERRED EMBODIMENTS

Figure 1:
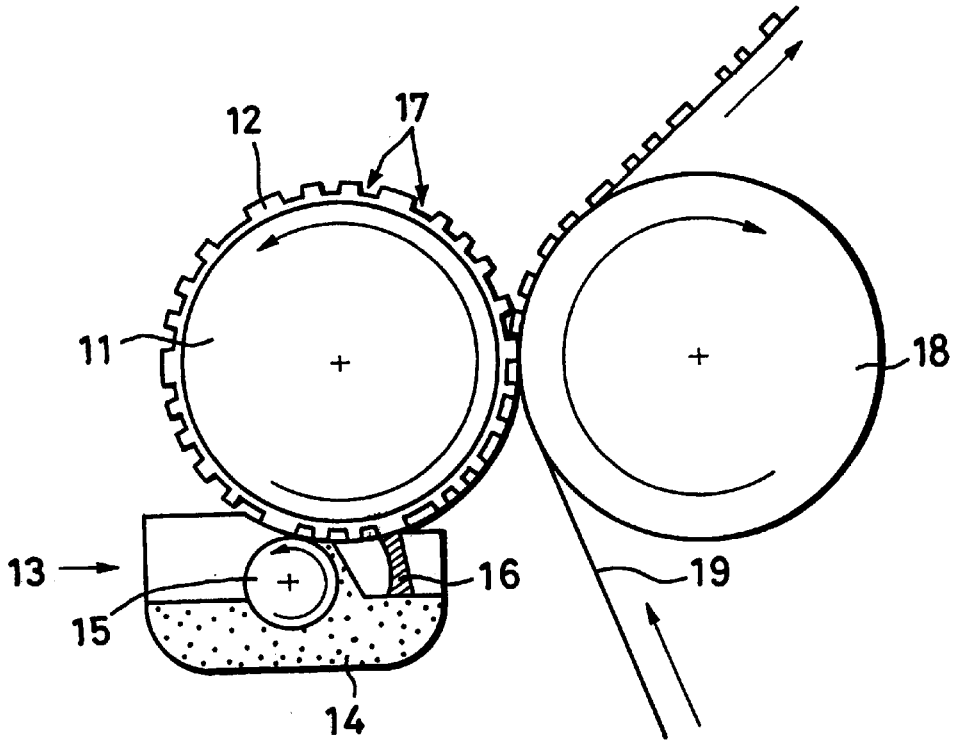
FIG. 1 is a diagram used to explain a principle of a gravure printing.

The present invention will hereinafter be described in detail.

A plate material for laser plate making according to the present invention contains a water repellent or an oil repellent in addition to thermoplastic resin and a light absorbing agent. Significance of the plate material's containing the water repellent or the oil repellent will hereinafter be described.

Such plate material for laser plate making has never contained the water repellent or the oil repellent (both of which will hereinafter be referred to as an ink repellent). The reason for this seems to be based on a supposition that if the plate material contains the ink repellent, then concavities of the plate material for laser plate making which should hold the ink repels the ink and hence it is impossible to obtain a satisfactory printed image. Specifically, in general, if a material to be coated with the ink contains the ink repellent, a contact angle of the ink relative to a surface of the material becomes large as compared with a material which does not contain the ink repellent. This increase of the contact angle means that a force by which the ink itself cohere becomes relatively larger as compared with a force by which the ink wets the material surface. Therefore, the ink is repelled by the surface.

However, even if the plate material for laser plate making contains the ink repellent, then when laser light is radiated on surfaces of the concavities of the plate material for laser plate making, the ink repellent thereon is heated to 500° C. or more, though for an extremely short period of time, and therefore decomposed. Density of the ink repellent at the surfaces of the concavities is lowered remarkably and a contact angle of an ink, such as the water base ink or the like, at the concavities obtained after the laser light is radiated becomes smaller as compared with that obtained before the laser light is radiated. Therefore, as long as the plate is made by using the laser light, it is substantially avoided that the concavities of the plate material for laser plate making which should keep the ink repels the ink.

Since the ink repellent still exists at a portion of the plate material for laser plate making where the laser light is not radiated, it is difficult for the ink to enter a minute scratch caused at the portion. Accordingly, even if the scratch exists thereat, it is possible to prevent the scumming and the linear scumming from being caused in a printed matter. In connection with this effect, in order to solve the problems of the scumming and the linear scumming in view of practical use, it is preferable that the plate material for laser plate making contains the ink repellent with which the contact angle of the ink relative to the plate material for laser plate making before the laser light is radiated to the concavities thereof becomes 55° or more.

When the plate material for laser plate making contains the ink repellent, the whole plate material for laser plate making can have high moisture-proof, thereby its dimensional stability being improved.

As described above, when the plate material for laser plate making contains the ink repellent, special effects can be achieved therein.

As described above, it is preferable for the plate material for laser plate making according to the present invention to contain the ink repellent with which the contact angle of the ink relative to the plate material for laser plate making and the ink before the laser light is radiated to the concavities thereof becomes 55° or more. Such ink repellent includes a fluorine water-repellent or oil-repellent, a silane water-repellent or oil-repellent, a siliconate water-repellent or oil-repellent, a silicone resin water-repellent or oil-repellent, an acrylic resin water-repellent or oil-repellent and so on.

The fluorine water-repellent includes, for example, fluorine water-repellents (manufactured by Tochem Product Co., Ltd. under the trade names of EF601, EF-801, EF-121 and EF-122C), a fluorine water-repellent (manufactured by DAIKIN INDUSTRIES, LTD. under the trade name of DS-406), a fluorine water-repellent (NIPPON OILS & FATS CO., LTD. under the trade name of Modiper F series) and so on. Among them, the fluorine water-repellent under the trade name of Modiper F series is especially preferable because it has high oil repellency and therefore is effective in repelling both of the water base ink and the oil base ink.

The silane water-repellent includes a silane water-repellent (manufactured by Tokyo Bose Industries, Co., Ltd. under the trade name of Watercut), a silane water-repellent (manufactured by Earth Shokai Co., Ltd. under the trade name of ENASEAL), a silane water-repellent (manufactured by SIKA LTD. under the trade name of CONSERVADO 5), silane water-repellents (manufactured by Sumitomo Seika Chemicals Co., Ltd. under the trade names of Aquaseal 2005, Aquaseal 4405 and Aquaseal), a silane water-repellent (manufactured by Sikoku Kaken Co., Ltd. under the trade name of MICRONGUARD), a silane water-repellent (manufactured by CEMEDINE CO., LTD. under the trade name of Aquashut), a silane water-repellent (manufactured by Manor Co., Ltd. under the trade name of New Concort) and so on.

The siliconate water-repellent includes a siliconate water-repellent (manufactured by Shin-Etsu Chemical Co., Ltd. under the trade name of Polon C), a siliconate water-repellent (manufactured by TOSHIBA SILICONE CO., LTD. under the trade name of TSW870), siliconate water-repellents (manufactured by DOW CORNING TORAY SILICONE CO., LTD. under the trade names of Dryseal C and SM8702), a siliconate water-repellent (manufactured by Permast Japan Co., Ltd. under the trade name of Perma.Paint), a siliconate water-repellent (manufactured by Franseal Japan Co., Ltd. under the trade name of LOADSILSILICONATE) and so on.

The silicone resin water-repellent includes silicone resin water-repellents (manufactured by Toshiba Silicone Co., Ltd. under the trade names of TSW810 and TSW771), silicone resin water-repellents (manufactured by Shin-Etsu Chemical Co., Ltd. under the trade names of Polon A and KC88), silicone resin water-repellents (manufactured by DOW CORNING TORY SILICONE CO., LTD. under the trade names of SH733 and Dryseal L), a silicone resin water-repellent (manufactured by CEMEDINE CO., LTD. under the trade name of Wetexy S), a silicone resin water-repellent (manufactured by Standard Kosan Co., Ltd. under the trade name of odex B), a silicone resin water-repellent (manufactured by Bayer Synthetic Silicone Co., Ltd. under the trade name of Baysilon Lo), a silicone resin water-repellent (manufactured by Sumitomo Seika Chemicals Co., Ltd. under the trade mark of Aquaseal 30F), a silicone resin water-repellent (manufactured by Nihon Tokushu Toryo Co., Ltd. under the trade name of Gonseal), and so on.

The acrylic resin water-repellent includes acrylic resin water-repellents (manufactured by Ozeki Sangyo Co., Ltd. under the trade names of Microguard R-20 and Microguard R-40), an acrylic resin water-repellent (manufactured by Sankei Kasei Co., Ltd. under the trade name of Rabalontop CH), an acrylic resin water-repellent (manufactured by Yamamoto Giken Co., Ltd. under the trade name of Yamatite #800), acrylic resin water-repellents (manufactured by FUJIKURA KASEI CO., LTD. under the trade names of Conseal CM-R, Conseal CM-O and Conseal CM-CL), an acrylic resin water-repellent (manufactured by Fujiwara Chemicals Co., Ltd. under the trade name of Tomex) and so on.

When the ink repellent of considerably small amount is used, the contact angle of the ink tends to become small to thereby lower ink repellency of the plate material for laser plate making. When the ink repellent of considerably large amount is used, its compatibility with another resin tends to be lowered and blocking tends to be caused with ease. Accordingly, it is preferable to use the ink repellent whose amount is within the range from 0.5 to 20 weight %, more preferably from 3 to 10 weight % in the plate material for laser plate making, although the range differs depending upon kinds of the ink repellent.

The thermoplastic resin used in the plate material for laser plate making according to the present invention includes a material which is to be decomposed and removed from a plate material by radiation of the laser light. Such material is resin which contains one kind of or plural kinds of the following materials; polyethylene, polypropylene, polyester, ester polyacrylate, polystyrene, poly(vinylidene chloride), polycarbonate, copolymer of ethylene and vinyl acetate, copolymer of ethylene and acrylate, copolymer of ethylene and vinyl alcohol, poly(vinyl acetate), urethane, polyacrylonitrile, polybutene, polyacetal, polyamide, polyimide, aramide, ionomer, nitrocellulose, poly(ethylene naphtalate), copolymer of methyl and terpene, poly(vinyl fluoride), fluororesin, ethylene trifluoride monoxide, ethylene tetrafluoride, olefin carboxylate and so on. It is preferable to use polyester of the above materials because it stinks a little when decomposed by the laser light.

It is preferable to use such thermoplastic resin of 10 to 90 weight %, which is different depending upon kinds of the thermoplastic resin to be used, in view of some conditions, such as when a film is formed by using the thermoplastic resin.

It is possible that light absorbing agents which can absorb a characteristic wavelength of the laser light used for engraving are properly selected and used in the plate material for laser plate making according to the present invention. For example, some proper light absorbing agents, such as carbon black, a near infrared ray absorbing agent or the like, can be used therein. Among them, use of carbon black is preferable in view of costs and efficiency in decomposition of the thermoplastic resin performed by the laser light. When such light absorbing agent of too small amount is used in the plate material, absorption amount of the laser light is lowered to thereby prevent the thermoplastic resin from being decomposed efficiently. Therefore, the plate depth tends to become shallow and contours of the concavities on the plate tend to become unclear. On the other hand, when such light absorbing agent of too large amount is used in the plate material, the absorption amount of the laser light becomes extremely increased to thereby reduce an amount of the laser light which is incident on the plate material deeply in the depth direction thereof. Therefore, also in this case, the plate depth tends to become shallow. As described above, it is preferable to set the amount of the light absorbing agent used therein within the range from 5 to 25 weight %, more preferably the range from 15 to 20 weight %.

It is preferable that the plate material for laser plate making according to the present invention further contains nitrocellulose for improvement of a laser engraving sensitivity. When an amount of nitrocellulose used therein is too small, the plate depth tends to become shallow. When the amount is too large, smoothness of the plate surface tends to be lowered. Therefore, it is preferable to set the amount of nitrocellulose used therein within the range from 10 to 90 weight %.

It is possible that the plate material for laser plate making according to the present invention further contains a resin curing agent, such as a melamine curing agent, an urethane curing agent or the like, and various kinds of additives, such as a leveling agent, a dispersing agent or the like.

Figure 2:
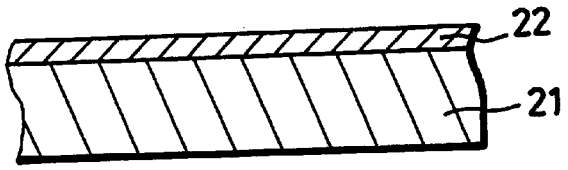
FIG. 2 is a cross-sectional view showing a plate sheet material for an intaglio formed of a plate material for laser plate making according to the present invention.

It is possible that the above-mentioned plate material for laser plate making according to the present invention is molded into a sheet and used as a plate sheet material for intaglio printing. However, it is preferable to use a plate sheet material for intaglio printing having, as shown in FIG. 2, a base sheet 21 made of proper materials, such as polyester or the like, and a laser engraving layer 22 which is formed thereon by using the plate material for laser plate making according to the present invention. When the plate sheet material is arranged as described above, it is possible to manufacture the plate sheet material by a coating method. Moreover, it becomes possible to mass-produce the plate sheet materials having satisfactory smoothness at a relatively low temperature. Moreover, it becomes easy to handle the plate sheet material.

The plate material for laser plate making according to the present invention can be manufactured by some proper known methods. For example, it is possible to manufacture the plate material by uniformly mixing the thermoplastic resin, the light absorbing agent, the ink repellent and other additives, such as nitrocellulose, if necessary, to mold the mixture into various kinds of forms (such as a sheet, a cylinder, a block or the like). Moreover, it is possible to manufacture the plate material by coating a liquid obtained by uniformly dispersing the thermoplastic resin, the light absorbing agent, the ink repellent and other additives, such as nitrocellulose, if necessary, in a solvent on a base made of polyester or the like, for example, to dry the coated liquid.

The present invention will hereinafter be described more specifically by using inventive examples.

INVENTIVE EXAMPLES 1 THROUGH 16

Compounding components shown in the following Table 1 (their compounding amounts are shown in FIG. 3) are dispersed and mixed by a sand mill and the dispersed and mixed compound is coated by the coating method on a polyester sheet (manufactured by TEIJIN LTD.) with a thickness of 188 μm to form a laser engraving layer with a thickness of 20 μm thereon. Thus, the plate material for laser plate making is manufactured.

TABLE 1

| compounding components | manufacturing companies and trade names |
|---|---|
| light absorbing agent (carbon black) | manufactured by Mitsubishi Kasei Corp. under the trade name of MA100 |
| thermoplastic resin (polyester) | manufactured by UNITIKA, LTD. under the trade name of UE3350 |
| nitrocellulose | manufactured by DAICEL CHEMICAL INDUSTRIES, LTD. under the trade name of RS1/16 |
| dispersing agent | manufactured by KUSUMOTO KASEI CO., LTD. under the trade name of DA400 |
| curing agent (melamine) | manufactured by SUMITOMO CHEMICAL CO., LTD. under the trade name of M100 |
| leveling agent | manufactured by Shin-Etsu Silicone Co., Ltd. under the trade name of KP340 |
| fluorine water-repellent | manufactured by Tochem Product Co., Ltd. under the trade name of EF601 |
| fluorine water-repellent | manufactured by Tochem Product Co., Ltd. under the trade name of EF801 |

In order to evaluate that it is difficult for the ink to enter a scratch caused on a surface of the plate material for laser plate making and that the ink is easily adhered to the surface of the concavities engraved by the laser light, contact angles of the water base ink were measured before and after the laser light was entirely radiated on plate materials of inventive examples 1 through 16. Measured results are shown in FIG. 4. If the contact angle measured before the radiation of the laser light is 55° or larger, then it is possible to evaluate that it is difficult for the ink to enter the scratch on the plate surface and decrease of printing quality can be suppressed as much as possible. If the contact angle measured after the entire radiation of the laser light is 53° or smaller, it is possible to evaluate that the ink is sufficiently adhered to the laser radiated portion in view of practical use.

COMPARATIVE EXAMPLES 1 THROUGH 16

Respective plate materials of comparative examples 1 through 16 were manufactured similarly to those of inventive examples 1 through 16 except that each of the plate materials of comparative examples 1 through 16 did not contain the water repellent. Contact angles of the water base ink were similarly measured with respect to the plate materials of comparative examples 1 through 16. Measured results are shown in FIG. 4.

Measured results shown in FIG. 4 reveal that while the ink is sufficiently adhered to each of the plate materials for laser plate making according to comparative examples 1 through 16 because the contact angle thereof measured after the radiation of the laser light is 32° or smaller, the ink enters the surface scratches on the plate materials of the comparative examples 1 through 16 with ease because the contact angles thereof measured before the radiation of the laser light are 37° or smaller.

On the other hand, it is difficult for the ink to enter the surface scratches on the plate materials for laser plate making according to the inventive examples 1 through 16 of the present invention because the contact angles thereof measured before the radiation of the laser light are 55° or more. The ink is sufficiently adhered to each of the plate materials for laser plate making according to the inventive examples 1 through 16 because the contact angle thereof after the radiation of the laser light is 53° or smaller.

When the printing is carried out with the intaglio obtained by engraving the plate material for laser plate making according to the present invention with the laser light, it is possible to drastically reduce factors to decrease the printing quality, such as the scumming or the linear scratch of the printed matter caused by the surface scratch of the intaglio although the intaglio is formed of the material mainly made of the thermoplastic resin which is soft as compared with the metal plate. Moreover, it is possible to improve the dimensional stability of the plate material.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the novel concepts of the present invention as defined in the appended claims.

What is claimed is:

1. An intaglio for mounting onto a printing apparatus and being scraped by an ink removal device, the intaglio for engaging a paper or film to be printed, the intaglio comprising:

a uniform mixture of a thermoplastic resin, a light absorbing agent and an ink repellent, the uniform mixture formed into a uniform structure having a surface which engages the ink removal device, the ink repellent being present in an amount ranging from about 0.5% to about 20%, the ink repellent being present in said amount so that the ink repellent is compatible with the thermoplastic resin so that the entire intaglio has uniform ink repellent properties, the ink repellent is a fluorine water-repellent other than polytetrafluoroethylene, a siliconate water-repellent, a siliconate oil-repellent, a silicone water-repellent, a silicone oil repellent, an acrylic resin water-repellent, an acrylic resin oil-repellent or mixtures thereof, the ink repellent being free of polytetrafluoroethylene, the intaglio further including a plurality of concavities formed in the surface by radiation of laser light, the concavities accommodating ink to be transferred to the paper or film, the surface including a plurality of scratches disposed between concavities and caused by engagement between the surface and the ink removal device, the scratches being shallower in depth than the concavities, the ink repellent preventing ink from being accommodated in the scratches and being transferred to the paper or film.

2. The intaglio of claim 1, further comprising a base sheet.

3. The intaglio of claim 1, further comprising nitrocellulose.

4. The intaglio of claim 3, wherein said thermoplastic resin ranges from about 10% to about 90% by weight, said nitrocellulose ranges from about 10% to about 90% by weight and said light absorbing agent ranges from about 5% to about 25% by weight.

5. The intaglio of claim 1, wherein said thermoplastic resin comprises polyester and said light absorbing agent comprises carbon black.

6. The intaglio of claim 1, wherein said light absorbing agent comprises carbon black.

7. The intaglio of claim 1, wherein a contact angle of an ink decreases after radiation of laser light.

* * * * *